United States Patent [19]

Kroeker

[11] 3,964,741

[45] June 22, 1976

[54] TRANSLATABLE STACKER APPARATUS

[75] Inventor: Elmer Leroy Bob Kroeker, Round Rock, Tex.

[73] Assignee: International Business Machines Corporation, Armonk, N.Y.

[22] Filed: June 27, 1975

[21] Appl. No.: 590,762

[52] U.S. Cl. ..... 271/213; 93/93 DP

[51] Int. Cl.[2] ..... B65H 33/08

[58] Field of Search ..... 271/213; 214/6 N; 93/93 DP, 93 K

[56] References Cited

UNITED STATES PATENTS 1,999,292 4/1935 Halvorsen ..... 93/93 K

OTHER PUBLICATIONS

"Sheet Stacking Technique", Manning et al.; IBM Technical Disclosure Bulletin; vol. 17, No. 8, Jan. 1975.

*Primary Examiner*—Evon C. Blunk
*Assistant Examiner*—Robert Saifer
*Attorney, Agent, or Firm*—James H. Barksdale, Jr.

[57] ABSTRACT

An apparatus for causing sheets to be stacked in an offset manner for facilitating later separation. The apparatus is made up primarily of a stacking bin into which sheets are fed from a sheet feeding apparatus, means for translating the bin from one position to another, biasing means for urging the bin toward one of the two positions to provide for startup, and a clutch. Upon command, the clutch is tripped, and the bin is initially translated under the influence of the biasing means. The bin is thereafter frictionally driven by the translating means to a position where a sheet, when loaded, will be offset from a previously loaded sheet.

9 Claims, 3 Drawing Figures

TRANSLATABLE STACKER APPARATUS

BACKGROUND OF THE INVENTION

1. Field of the Invention

This invention relates generally to sheet feeding and handling. More specifically, this invention relates to stacking particular sheets offset from other sheets such that later separation is readily attainable.

2. Description of the Prior Art

Heretofore, a common technique of separating sheets, such as magnetic recording cards, has been to feed the sheets into separate bins. This has required considerable space and elaborate controls and structure. Another technique has involved collating wherein, for example, a number of copies of a document are to be reproduced with an electrostatic plain paper copier. The sheets making up each copy are to be automatically sorted and stacked together. Here again, complicated structure and controls, as well as considerable space, are required. There are no known compact prior art devices, having a single stacking bin for preparing sheets for separation, and which require a minimum of control and structure. This is particularly the case when the device is to be driven by the same drive that causes the sheets to be driven into a stacking bin. This, in addition to actuation of the device by a clutch to insure proper timing, is not known.

SUMMARY OF THE INVENTION

In accordance with this invention, an apparatus is provided for facilitating later separation of sheets which are fed from a work station or sheet feeding apparatus into a single stacking bin. The apparatus is primarily made up of a spring-loaded and translatable stacking bin, and a clutch having a friction drive. The apparatus can be driven off of the same drive which causes feeding of sheets from the work station. This will insure proper timing and reduce ancillary apparatus. Sheets output from the work station are fed into the stacking bin and stacked one on top of another. When it is desired to feed a particular sheet into the stacking bin for later separation from the remainder of the sheets, the clutch is tripped. The bin is then initially displaced and translated under the influence of a spring to cause engagement of the friction drive. The friction drive further pivots the bin a sufficient amount for the sheet being loaded to be offset from the remainder of the stack. Thereafter, the bin is returned to its original spring-loaded position for normal stacking of subsequent sheets.

DESCRIPTION OF THE PREFERRED EMBODIMENT

Figure 1:
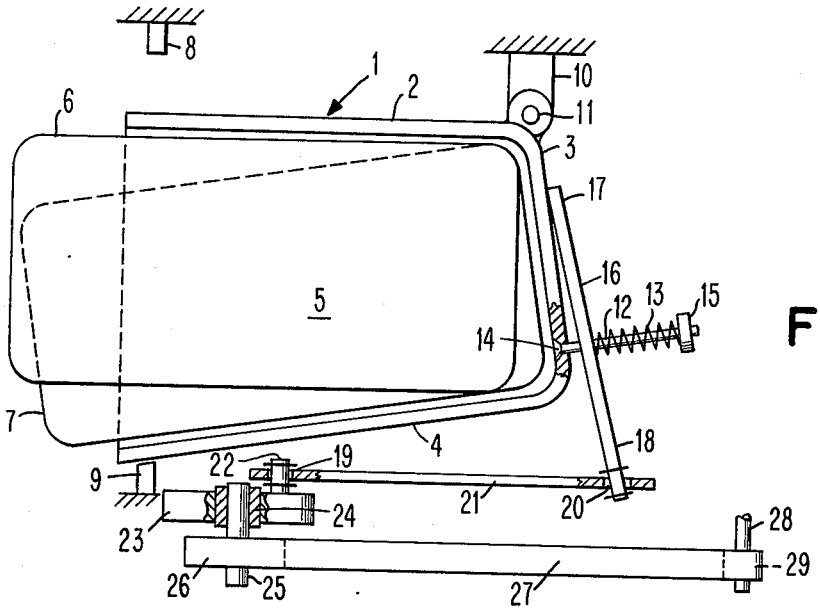
FIG. 1 is a plan view of the apparatus according to this invention illustrating sheets stacked offset relative to one another.

Referring first to FIG. 1, there is shown a stacker or stacking bin generally designated by reference numeral 1. This bin serves as a receiving means for receiving sheets fed one at a time from a sheet feeding apparatus (not shown). Bin 1 is made up of side walls 2 and 4, end wall 3, and bottom 5. Sheets fed into bin 1 are transported over the top of end 3 and are permitted to fall toward bottom 5. The end of bin 1 opposite end 3 is open for facilitating removal of stacked sheets, such as 6 and 7. Side 4 is not parallel to side 2 and one reason therefore is to cause received sheets to be offset more about one end than another. Other reasons therefore will become more apparent later in the specification.

Sheets 6 and 7 can be considered to be magnetic recording cards. Such cards have a fairly low coefficient of friction. With this being the case, a relatively large number of cards can be stacked in an offset manner and readily separated later. When sheets of plain paper are considered, a higher coefficient of friction is involved. Therefore, in this case it would be desirable that the stack be somewhat limited in terms of numbers of sheets. Otherwise, later separation could become rather difficult. In any event, the usefulness of this improved apparatus is apparent.

Bin 1 is pivotable about point 11 and maintained by support 10 which is secured to a frame or other suitable means. Bin 1 is pivotable and translatable between stops 8 and 9. Stops 8 and 9 define the extent of translation of bin 1 between a first and second position. It will be assumed that, as shown in FIG. 1, bin 1 is in a first or normal position. In this position, bin 1 is spring-biased in a clockwise direction about point 11. This is due to spring 13 and bias rod 16. Spring 13 and bias rod 16 both serve as biasing means for urging bin 1 toward the second position when it is in the vicinity of the first position. This will be more fully appreciated later in the specification. In the first position, drive rod 21 is being held. End 18 of bias rod 16 is positioned in opening 20 in rod 21. The other end 17 of bias rod 16 is acting against end 3 of bin 1. Spring 13 is maintained on rod 12 by collar 15 and bias rod 16. End 14 of rod 12 is secured to end 3 of bin 1.

Figure 2:
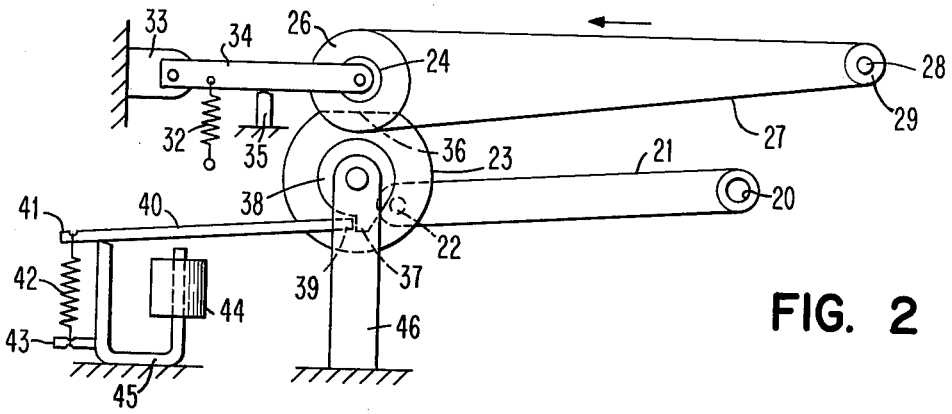
FIG. 2 is a front view of the clutch and included friction drive portion of the apparatus shown in FIG. 1.

The lower portion of FIG. 1 can best be appreciated by referring to FIG. 2 in conjunction therewith. As pointed out above, in the position shown for bin 1, drive rod 21 is being held. This is due to end 39 of armature 40 being in engagement with stop 37 on cam 38. The left end of drive rod 21 is rotatably and freely mounted on eccentric pin 22. Pin 22 is secured to primary drive wheel 23 and fitted in opening 19 in drive rod 21. Primary drive wheel 23 is rotatable about a shaft in the upper end of support 46. Support 46 is secured to a frame or other suitable means. Primary drive wheel 23 has a flat 36. Flat 36 permits a secondary drive wheel 24 to remain out of contact with primary drive wheel 23 when bin 1 is in the position shown in FIG. 1. Secondary drive wheel 24 is connected through shaft 25 to wheel 26. Both wheels 24 and 26 are secured to shaft 25 and rotate in unison. Wheel 26 is driven by belt 27 through wheel 29 which is connected to a shaft 28. Wheels 24, 26, and 29 are normally continuously rotated. Shaft 28 is connected to a freely rotating drive wheel which is picked at a particular time for feeding a sheet from the sheet feeding apparatus referred to above.

Wheels 24 and 26 are biased in the position shown by means of tension spring 32 acting on rod 34. The clockwise travel of rod 34 is limited by stop 35. Rod 34 is pivotable on support 33 which is connected to the apparatus frame or other suitable means.

Armature 40 forms part of a magnet/armature assembly made up of magnet windings 44, core piece 45, spring 42, and spring support 43. The end of spring 42, opposite that connected to spring support 43, is connected to end 41 of armature 40.

From the above, armature 40 and cam 38 serve as holding means for maintaining bin 1 in the first position. Magnet windings 44 serve as releasing means for releasing bin 1 for translation to the second position.

Sheets fed into bin 1 in the position shown in FIG. 1 are stacked one on top of another in the location of sheet 6. When a sheet is to be stacked offset with respect to sheet 6, stacking in the location of sheet 7 is desired. This is accomplished by supplying power to magnet windings 44 and causing armature 40 to be displaced in a downward direction. This will bring end 39 of armature 40 out of engagement with stop 37 of cam 38, and permit clockwise rotation of primary drive wheel 23. This clockwise rotation of primary drive wheel 23 is under the influence of spring 13. End 17 of bias rod 16 is acting against end 3 of bin 1, and bias rod 16 is separated from end 3 along rod 12. Therefore, spring 13 is urging drive rod 21 to the left. The separation of bias rod 16 and end 3, along rod 12, is sufficient for drive rod 21 to cause limited rotation of primary drive wheel 23. This limited rotation is in turn sufficient to cause the circular peripheral surface of primary drive wheel 23 to be brought into engagement with the periphery of secondary drive wheel 24. When primary drive wheel 23 is in engagement with secondary drive wheel 24, bin 1 will no longer be pivoting in a clockwise direction about point 11 under the influence of spring 12. At this time, pivoting is under the influence of wheels 23 and 24.

During the time that the periphery of secondary drive wheel 24 is in engagement with the circular periphery of primary drive wheel 23, bin 1 will first be driven in a clockwise direction and against stop 8. When bin 1 is against stop 8, a sheet fed into bin 1 will assume the location of sheet 7. Thereafter, upon continued rotation and engagement of wheels 23 and 24, bin 1 will be returned to the position shown in FIG. 1. Upon the return of bin 1 to stop 9, the circular periphery of primary drive wheel 23 will come out of engagement with the circular periphery of secondary drive wheel 24. When bin 1 is brought against stop 9, there will be a latching of armature 8 and stop 37. Bin 1 will then be maintained in the position shown in FIG. 1 until it is desired to offset another sheet.

Figure 3:
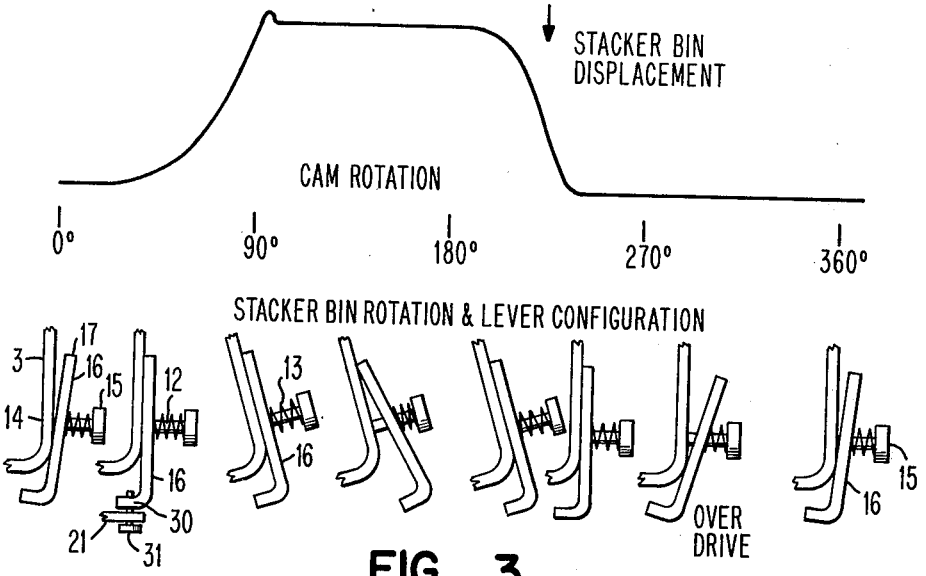
FIG. 3 is an illustration of the relationship of the stacker bin displacement, clutch cam rotation, and the stacker lever positions during operation of the apparatus shown in FIG. 1.

Referring next to FIG. 3, there is illustrated the relationship of the displacement of bin 1, rotation of cam 38, and bias rod or lever 16. This is a pictorial representation which also illustrates another embodiment for the connection of drive rod 21 and bias rod or lever 16. Instead of end 18 being journaled in end 20, rod 16 is L-shaped and connected to rod 21 about end 30 through pin 31.

In summary, an apparatus is provided for facilitating later separation of sheets which are fed from a work station or sheet feeding apparatus into a single stacking bin. The apparatus is primarily made up of a spring-loaded and translatable stacking bin, and a clutch having a friction drive. The apparatus can be driven off of the same drive which causes feeding of sheets from the work station. This will insure proper timing and reduce ancillary apparatus. Sheets output from the work station are fed into the stacking bin and stacked one on top of another. When it is desired to feed a particular sheet into the stacking bin for later separation from the remainder of the sheets, the clutch is tripped. The bin is then initially displaced and translated under the influence of a spring to cause engagement of the friction drive. The friction drive further pivots the bin a sufficient amount for the sheet being loaded to be offset from the remainder of the stack. Thereafter, the bin is returned to its original spring-loaded position for normal stacking of subsequent sheets.

While the invention has been particularly shown and described with reference to a particular embodiment, it will be understood by those skilled in the art that various changes in form and detail may be made without departing from the spirit and scope of the invention.

What is claimed is:

1. An apparatus for causing sheets to be stacked offset relative to one another, said apparatus comprising:

a. means for receiving said sheets fed from a sheet feeding apparatus, said receiving means being translatable between a first position and a second position;

b. means for holding said receiving means in said first position;

c. means for releasing said holding means;

d. means for biasing and urging said receiving means toward said second position when said receiving means is in the vicinity of said first position; and e. means, upon said holding means being released by said releasing means and after said receiving means has been urged away from said first position by said biasing and urging means, for causing said receiving means to be translated to said second position, and including means for causing said receiving means to be translated from said second position to said first position after said receiving means has been translated to said second position.

2. An apparatus according to claim 1 wherein said releasing means includes means for causing automatic engagement of said holding means for maintaining said receiving means in said first position after said receiving means has been translated from said second position to said first position.

3. An apparatus according to claim 2 including means for limiting the extent of translation of said receiving means from said first position and defining said second position.

4. An apparatus according to claim 2 including means for limiting the extent of translation of said receiving means from said second position and defining said first position.

5. An apparatus according to claim 2 wherein said translating means is driven by means included in said sheet feeding apparatus for feeding said sheets to said receiving means.

6. An apparatus according to claim 5 wherein said translating means includes friction driving means for causing said receiving means to be translated to said second position and then to said first position.

7. An apparatus according to claim 6 wherein said receiving means is translatable about a pivot means for causing said sheets to be offset more about one end than another end.

8. An apparatus according to claim 7 wherein said friction driving means includes means for maintaining said friction driving means out of engagement when said receiving means is in said first position.

9. An apparatus according to claim 8 including means for defining said first and second positions.

* * * * *